US011673767B2

(12) United States Patent
Stripling et al.

(10) Patent No.: US 11,673,767 B2
(45) Date of Patent: Jun. 13, 2023

(54) ELEVATOR SYSTEMS

(71) Applicant: Otis Elevator Company, Farmington, CT (US)

(72) Inventors: Ralph S. Stripling, Berlin (DE); Sven Knuth, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 474 days.

(21) Appl. No.: 16/849,448

(22) Filed: Apr. 15, 2020

(65) Prior Publication Data

US 2020/0324999 A1 Oct. 15, 2020

(30) Foreign Application Priority Data

Apr. 15, 2019 (EP) ..... 19169324

(51) Int. Cl.
*B66B 1/34* (2006.01)
*B66B 1/24* (2006.01)
(Continued)

(52) U.S. Cl.
CPC ..... *B66B 1/3407* (2013.01); *B66B 1/24* (2013.01); *B66B 3/002* (2013.01); *B66B 5/0087* (2013.01); *B66B 5/025* (2013.01)

(58) Field of Classification Search
CPC ..... B66B 5/0031; B66B 5/02; B66B 5/0087; B66B 5/00; B66B 5/0025; B66B 5/0018; B66B 3/00; B66B 13/22; B66B 5/005; B66B 5/0006; B66B 3/002; B66B 1/36; B66B 5/06; B66B 5/0093; B66B 5/0043; B66B 11/02; B66B 13/16; B66B 13/14; B66B 5/0062; B66B 5/0056; B66B 13/02; B66B 1/46; B66B 1/48; B66B 11/0246;
(Continued)

(56) References Cited

U.S. PATENT DOCUMENTS 6,173,814 B1 1/2001 Herkel et al.
6,223,861 B1 5/2001 Sansevero
(Continued)

FOREIGN PATENT DOCUMENTS

CN 110027959 A * 7/2019 ..... B66B 1/06
CN 110077929 A * 8/2019 ..... B66B 5/0031
(Continued)

OTHER PUBLICATIONS

European Search Report for application EP 19169324.1, dated Oct. 24, 2019, 100 pages.

*Primary Examiner* — Marlon T Fletcher
(74) *Attorney, Agent, or Firm* — Cantor Colburn LLP

(57) ABSTRACT

An elevator system 2 is provided which comprises: a hoistway 6 accessible by at least one hoistway door 10*a*, 10*b*, 10*c*; at least one elevator car 4 located in the hoistway 6; a hoistway door switch 12*a*, 12*b*, 12*c* associated with the at least one hoistway door 10*a*, 10*b*, 10*c*; at least one inspection switch 16; at least one emergency stop switch 18; and an elevator controller 24. The elevator controller 24 is configured to monitor the hoistway door switch 12*a*, 12*b*, 12*c*, the inspection switch 16 and the emergency stop switch 18 and to prevent inspection mode operation of the elevator car 4 until at least one change of state is detected of each of the hoistway door switch 12*a*, 12*b*, 12*c*, the inspection switch 16 and the emergency stop switch 18.

12 Claims, 3 Drawing Sheets

(51) Int. Cl.
*B66B 3/00* (2006.01)
*B66B 5/00* (2006.01)
*B66B 5/02* (2006.01)

(58) Field of Classification Search
CPC ... B66B 1/3438; B66B 11/0045; B66B 13/00; B66B 25/006
See application file for complete search history.

(56) References Cited

U.S. PATENT DOCUMENTS

| | | | | |
|---|---|---|---|---|
| 6,467,585 | B1 * | 10/2002 | Gozzo | B66B 13/22 187/247 |
| 11,305,965 | B2 * | 4/2022 | Lindegger | B66B 5/027 |
| 2018/0162692 | A1 * | 6/2018 | Herkel | B66B 13/22 |
| 2020/0324999 | A1 * | 10/2020 | Stripling | B66B 5/0087 |

FOREIGN PATENT DOCUMENTS

| | | | | | |
|---|---|---|---|---|---|
| CN | 111699148 | A | * | 9/2020 | B66B 3/002 |
| CN | 112449631 | A | * | 3/2021 | |
| DE | 112011105918 | T5 | | 9/2014 | |
| EP | 2033927 | A1 | | 3/2009 | |
| EP | 3725722 | A1 | * | 10/2020 | B66B 1/24 |
| EP | 3434634 | B1 | * | 1/2021 | B66B 1/06 |
| JP | 2005206346 | A | * | 8/2005 | |
| WO | WO-0051929 | A1 | * | 9/2000 | B66B 1/34 |
| WO | WO-2004013030 | A1 | * | 2/2004 | B66B 1/34 |
| WO | WO-2006072195 | A1 | * | 7/2006 | B66B 13/22 |
| WO | WO-2013084279 | A1 | * | 6/2013 | B66B 13/22 |
| WO | 2017008849 | A1 | | 1/2017 | |
| WO | WO-2017008849 | A1 | * | 1/2017 | B66B 5/005 |
| WO | WO-2019106778 | A1 | * | 6/2019 | B66B 5/00 |
| WO | WO-2019219406 | A1 | * | 11/2019 | B66B 3/002 |

* cited by examiner

ELEVATOR SYSTEMS

FOREIGN PRIORITY

This application claims priority to European Patent Application No. 19169324.1, filed Apr. 15, 2019, and all the benefits accruing therefrom under 35 U.S.C. § 119, the contents of which in its entirety are herein incorporated by reference.

TECHNICAL FIELD

The present disclosure relates to systems and methods for ensuring safe access to an elevator hoistway such as access to the top of an elevator car or access to the pit during elevator maintenance.

BACKGROUND

It is often necessary during elevator installation and maintenance for personnel (e.g. an elevator technician) to enter an elevator hoistway, for example to perform an inspection run using controls located on the top of an elevator car or to inspect the pit of the hoistway (underneath an elevator car).

It is important in such situations for unintentional movement of the elevator car to be prevented, to avoid injuries to maintenance personnel (e.g. by crushing). As such, elevator systems normally include various switches and sensors arranged to prevent normal operation of the elevator when the system is in a particular state. For example, a hoistway door switch (or sensor) may prevent normal operation of the elevator when any of the hoistway doors are open. An inspection switch, typically located on top of the elevator car, may be used to put the elevator system into an "inspection mode" in which normal operation of the elevator car is prevented, but inspection operation is permitted (e.g. in which the car is moveable at a reduced speed and/or under the direct control of a technician). An emergency stop switch may also be provided (e.g. also located on top of the elevator car or in the pit) which, when in a stop position, prevents all movement of the elevator car.

These switches can prevent potentially serious accidents. However, if one or more of these switches is faulty, unsafe operation of the elevator with someone in the hoistway can occur. Typically, therefore, the correct operation of each switch must be tested individually before maintenance can begin. However, this testing process can be time-consuming and its correct execution relies upon the diligence and attentiveness of the individual(s) entering the hoistway.

SUMMARY

According to one aspect of the present disclosure there is provided an elevator system comprising: a hoistway accessible by at least one hoistway door; at least one elevator car located in the hoistway; a hoistway door switch associated with the at least one hoistway door; at least one inspection switch; at least one emergency stop switch; and an elevator controller; wherein the elevator controller is configured: to monitor the hoistway door switch, the inspection switch and the emergency stop switch; and to prevent inspection mode operation of the elevator car until at least one change of state is detected of each of the hoistway door switch, the inspection switch and the emergency stop switch.

According to a second aspect of the present disclosure, there is provided a method of operating an elevator system comprising at least one elevator car located in a hoistway, said hoistway being accessible by at least one hoistway door, the method comprising: monitoring a hoistway door switch associated with the at least one hoistway door, an inspection switch and an emergency stop switch; and preventing inspection mode operation of the elevator car until at least one change of state is detected of each of the hoistway door switch, the inspection switch and the emergency stop switch.

Because the switches are individually monitored and operation of the elevator system is prevented until at least one change of state is detected of each of the switches, the system can be confident that each of the switches is functional before activating an inspection mode, e.g. in which a technician controls movement of an elevator car from within the hoistway. The technician is forced to test each switch before the inspection mode can be used by the technician. If one or more of the switches are faulty (i.e. they do not change state when operated by the technician), the system prevents inspection operation of the elevator system (i.e. until the fault is resolved). The controller may be configured to prevent all operation (i.e. including normal operation) of the elevator system if a change of state is detected of at least one, but not all of the switches, as this may indicate that a technician has entered or is about to enter the hoistway. For example this may be the case where a change of state is detected in the inspection mode switch or the emergency stop switch, or where a change of state is detected in the hoistway door switch while the elevator is not at the corresponding floor.

In contrast, current elevator control systems require the technician to follow a specific safety protocol before activating an inspection mode but are not able to enforce this protocol. A technician is expected to put each switch in turn into a state which should prevent operation of the elevator system (e.g. the emergency stop switch may be put in a STOP state), and then to test that the switch is operational by verifying that the elevator system actually cannot operate. This process must be repeated separately for each switch so as to ensure that all the switches are functional. This can be particularly time-consuming and inconvenient if one or more of the switches is located within the hoistway, because testing the switch(es) in the hoistway requires a technician to enter and exit the hoistway (or reach into the hoistway) potentially several times (opening and closing the doors each time) before inspection can begin.

The protracted nature of the conventional testing process increases the risk that one or more steps/tests may be bypassed by an untrained, inattentive or inexperienced technician. This can lead to unsafe inspection operation (e.g. in which the emergency stop button is faulty and thus cannot be relied upon to halt operation in an emergency). In examples of the current disclosure, however, a technician is forced by the elevator system to test the operation of each switch before inspection mode operation of the elevator is possible (if one or more switches are not operated the system will prevent all operation until they have been operated and verified as functioning correctly). The testing procedure itself is also simpler and faster, with the need for manual checking of elevator operation reduced or even entirely eliminated.

During normal operation of an elevator system, an elevator car moves between floors of a building to transport passengers therebetween. In some examples of the present disclosure, therefore, the elevator system may comprise a plurality of hoistway doors (e.g. associated with a plurality of floors of a building). Each hoistway door is normally closed, but is opened in synchrony with the doors of the elevator car when the elevator car arrives at the floor associated with the hoistway door, to allow passengers to enter or exit the elevator car. In normal operation, the hoistway doors are arranged to open only when aligned with the doors of the elevator car. The plurality of hoistway doors may have a plurality of hoistway door switches associated therewith. The elevator controller is preferably configured to monitor each of the plurality of hoistway door switches.

However, during elevator installation or maintenance the hoistway doors may be used to access the hoistway itself, by an elevator technician forcing open the hoistway doors (e.g. using an override control or by mechanically forcing the doors open) when they are not aligned with an elevator car. For example, a technician may force open a set of hoistway doors whilst the elevator car is positioned adjacent to the floor below, to enable the technician to access the top of the elevator car. The opening of a hoistway door unaccompanied by the opening of an elevator car door can therefore indicate to the elevator system that access to the hoistway is possible and that a technician has entered, or is about to enter, the hoistway. The elevator controller is preferably configured to prevent normal operation whenever the hoistway door switch (or any hoistway switch of a plurality of such switches) indicates that the hoistway is accessible, to avoid unexpected elevator car movement whilst a technician is in the hoistway.

The hoistway door switch is preferably arranged to change state when its associated hoistway door is opened or closed. The hoistway door switch preferably changes state automatically as the hoistway door opens/closes (i.e. it does not rely on any direct user interaction). The elevator system may further comprise at least one elevator car door switch, which is arranged to change state when an associated elevator car door is opened or closed. If a change of state of the hoistway door switch is not accompanied by a change of state of an elevator car door switch, the elevator system can infer that a hoistway door has been opened to allow access to the hoistway and not simply as part of normal elevator operation. In some examples, the elevator controller may be configured to prevent normal operation of the elevator car if a change of state of the hoistway door switch is unaccompanied by a change of state of the elevator car door switch (i.e. when an opening of the hoistway door is unaccompanied by that of an elevator door, meaning the hoistway may be accessible via the hoistway door).

Preventing elevator operation whilst the hoistway door is open onto the hoistway can prevent accidental elevator movement, helping to prevent injuries. However, in some scenarios an elevator technician may wish to move the elevator car even with the hoistway door open and so the detection of an open hoistway door should not unconditionally prevent inspection mode operation of the elevator car.

The inspection switch may be located outside of the hoistway (e.g. in an elevator lobby area). However, in a preferred set of examples the inspection switch is located within the hoistway, for example on top of the elevator car or in a hoistway pit area (underneath the elevator car). In examples where the inspection switch is located within the hoistway, preferably it is located such that it can be reached from outside the hoistway (i.e. so that it can be operated without a technician actually entering the hoistway). When the switch is located on top of the elevator car, it may be located in a position on top of the elevator car which is accessible by a technician located outside the hoistway. For example, the switch may be positioned on a side of the top of the elevator car proximal to the hoistway door.

In examples where the inspection switch is located outside of the hoistway, it is preferably located such that it can be reached from inside the hoistway (i.e. so that it can be operated without a technician exiting the hoistway). For example, the switch may be positioned in close proximity to the hoistway door.

The inspection switch preferably can be placed in at least an inspection mode position and a normal mode position. The inspection switch may comprise a physical switch (e.g. a button, a toggle or a rotary switch).

In some examples the elevator system may further comprise a set of elevator inspection controls arranged to be used by a technician to operate the elevator car when the elevator system is in the inspection mode. The elevator inspection controls are preferably only functional when the elevator system is in the inspection mode. The elevator inspection controls may be located alongside the inspection switch (e.g. on top of the elevator car). The inspection controls may allow the car to be moved at a reduced "inspection" speed, for instance to perform inspection runs. The elevator inspection controls may, for example, comprise an up control and a down control to control upward and downward movement of the elevator car. The elevator inspection controls may further comprise a confirmation or command control (e.g. a command button) arranged to be operated in conjunction with an up or down control. The elevator inspection controls may only allow the car to move upwards or downwards when the up or down control respectively is operated in conjunction with the command button. This may help to prevent accidental movement of the elevator car.

The emergency stop switch is arranged to prevent all movement of the elevator car when operated (e.g. when it is put into a STOP position). The emergency stop switch may subsequently need to be manually reset (e.g. placed into a GO position) before any operation of the elevator system is permitted. The emergency stop switch may be located outside of the hoistway, but in a set of preferred examples the emergency stop switch is located within the hoistway. The emergency stop switch may, for example be located on top of the elevator car or elsewhere in the hoistway (e.g. in a pit of the hoistway). As with the inspection switch, in examples where the emergency stop switch is located inside the hoistway, it is preferably reachable from outside the hoistway. In examples where the emergency stop switch is outside the hoistway, it is preferably reachable from inside the hoistway.

The elevator system may comprise one or more additional switches which may also need to be tested before inspection operation is allowable. The elevator controller may be further configured to prevent inspection mode operation of the elevator car until at least one change of state is detected of each of the one or more additional switches (e.g. until a change of state is detected on an up/down/command control of a set of elevator inspection controls).

The elevator controller may be arranged to indicate (e.g. via one or more indicator lights, a display or an audible indication/message) the switches of which at least one change of state has been detected (and/or equally the switches of which at least one change of state has not been detected). This may facilitate the identification and subsequent repair of a faulty switch. For example, if a technician has toggled each of the switches in readiness for an inspection run, but the controller indicates that it has detected a change of state of only the hoistway door safety switch and the inspection switch, the technician can deduce that the emergency stop switch is faulty and may commence suitable repairs. Such indication may, if convenient, be made by transmitting a signal to a mobile device such as a mobile telephone or tablet or laptop computer.

The elevator controller may be further configured to return the elevator system to a normal mode if, whilst the elevator system is operating in the inspection mode, the inspection switch is placed into a normal operation position. In such cases, movement of the elevator car may still be prevented, for example by a hoistway door being open. To further ensure the safety of maintenance personnel who may remain in the hoistway even after the inspection switch has been put into the normal operation position, the elevator controller may be configured with one or more further requirements which must be met before normal operation may be resumed. For example, the elevator system may comprise a reset switch located outside the hoistway which must be operated before normal operation can resume.

Once normal operation has been resumed from the inspection mode, subsequent operation of the elevator system in the inspection mode may require a change of state to again be detected on each switch, to ensure that the system is fully tested each time the inspection mode is entered. In alternative arrangements inspection mode operation may be resumed within a predetermined time period on the basis that the previous checks of the various switches are still valid. In some examples the system may only require a change of state to be detected on each switch once per power cycle.

The elevator controller may be arranged to monitor each of the switches by directly monitoring the physical state of each switch (e.g. by measuring a resistance between two switch contacts). Alternatively, the switches may control respective inputs to the elevator controller, and it is the state of these inputs that are monitored by the elevator controller.

The elevator system is preferably in compliance with the PESSRAL (Programmable Electronic Systems in Safety Related Applications for Lifts) standard.

The elevator system may comprise a plurality of elevator cars. The elevator system may comprise a plurality of hoistways each with at least one associated elevator car and hoistway door. The plurality of hoistways may be separate, although in some examples they are adjacent such that they form one continuous elevator shaft space. Each hoistway may comprise a separate inspection switch and/or a separate emergency stop switch. In some such examples, when the elevator controller is configured to prevent elevator car movement, it may prevent movement of all elevator cars in all hoistways. Alternatively, the elevator controller may be configured to only prevent the movement of the elevator car(s) of the hoistway with which the switches are associated.

Features of any example described herein may, wherever appropriate, be applied to any other example described herein. Where reference is made to different examples or sets of examples, it should be understood that these are not necessarily distinct but may overlap.

DRAWING DESCRIPTION

Certain examples of the present disclosure will now be described with reference to the accompanying drawings in which.

DETAILED DESCRIPTION

Figure 1:
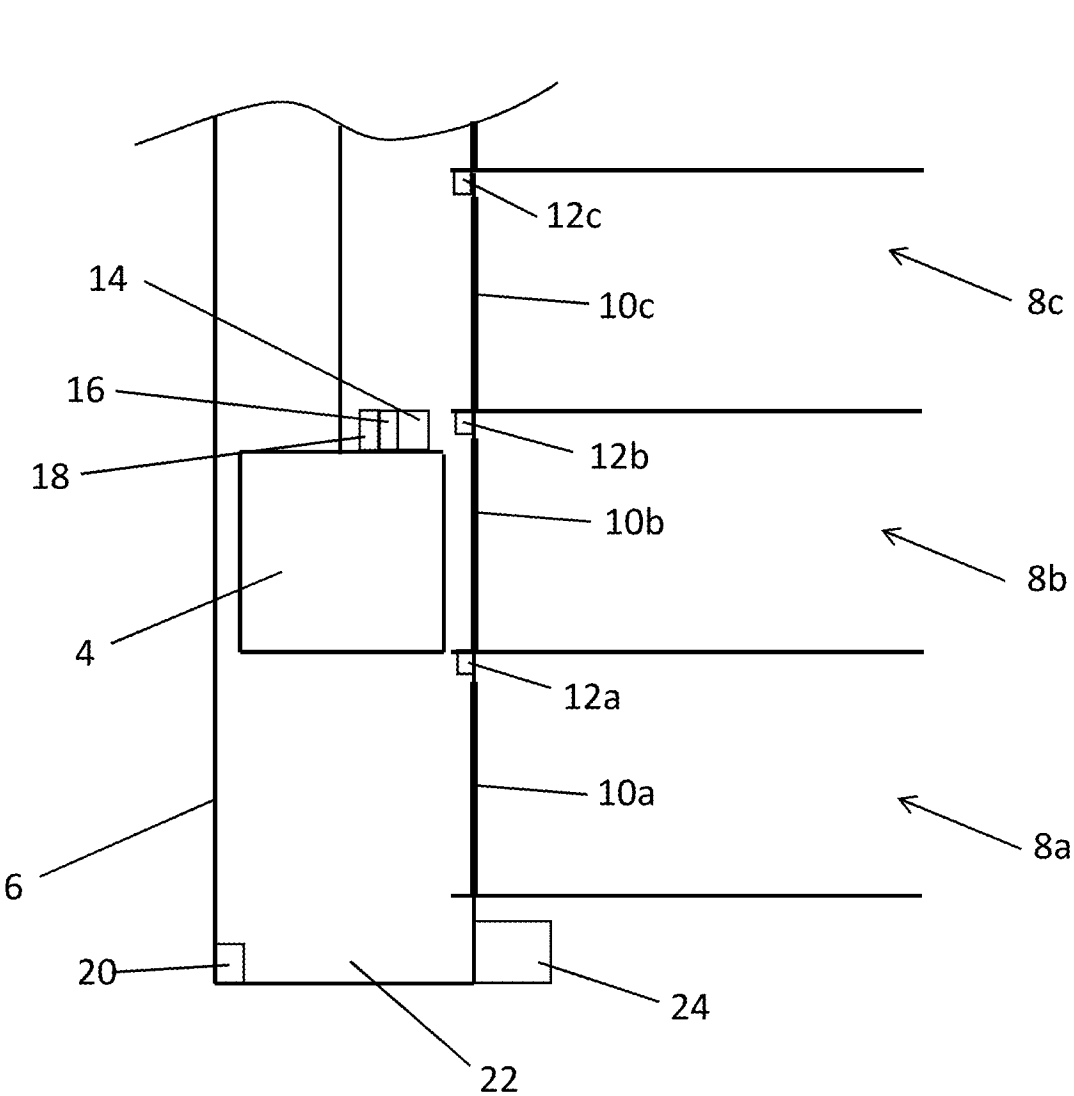
FIG. 1 shows an elevator system according to an example of the present disclosure.

FIG. 1 shows an elevator system 2 for transporting passengers within a building. The elevator system 2 comprises an elevator car 4 that is arranged to move within a hoistway 6 to carry passengers between floors 8*a*, 8*b*, 8*c* of the building. Each floor 8*a*, 8*b*, 8*c* has a hoistway door 10*a*, 10*b*, 10*c* used by passengers to access the elevator car 4.

In normal operation, the elevator car 4 moves in the hoistway 6 to transport passengers between the floors 8*a*, 8*b*, 8*c*, for example in response to hall calls or destination calls entered by the passengers. In normal operation, the hoistway doors 10*a*, 10*b*, 10*c* open only to allow access to the elevator car 4 and are arranged not to open unless the elevator car 4 is aligned therewith.

However, access to the inside of the hoistway 6 may occasionally be required by a technician or engineer, e.g. to carry out inspection of or maintenance to the elevator system 2. On such occasions, the hoistway doors 10*a*, 10*b*, 10*c* may be used to access directly the hoistway 6. The technician may use an override switch (not shown) or simply manual force to open one of the hoistway doors 10*a*, 10*b*, 10*c* whilst the elevator car 4 is not aligned therewith, thus granting the technician access to the hoistway 6. In FIG. 1 the elevator car is shown adjacent to the first floor 8*b* of the building.

Before a technician enters the hoistway 6, however, normal operation of the elevator system 2 must be prevented, to avoid unexpected motion of the elevator car 4 (e.g. in response to a passenger call on another floor) whilst the technician is within the hoistway 6.

Each of the hoistway doors 10*a*, 10*b*, 10*c*, is therefore provided with a hoistway door switch 12*a*, 12*b*, 12*c*. The hoistway door switches 12*a*, 12*b*, 12*c* are arranged to change state when a hoistway door 10*a*, 10*b*, 10*c* is opened. The elevator system 2 is configured such that when one or more of the hoistway door switches 12*a*, 12*b*, 12*c* indicates that one or more hoistway doors 10*a*, 10*b*, 10*c* is open onto the hoistway 6, normal operation is prevented. This mitigates the likelihood of unexpected movement of the elevator car 4 whilst a technician is inspecting the hoistway 6.

During an elevator inspection, a technician may perform an "inspection run", in which the elevator car 4 is moved (normally at a slow speed) in the hoistway 6 under manual control of the technician. During an inspection run, movement of the elevator car 4 is controlled using inspection controls 14 located on top of the elevator car 4 (e.g. comprising up and down buttons). The elevator system 2 must be in an inspection mode for the inspection controls 14 to be used (i.e. they are not functional unless the system 2 is in the inspection mode). The elevator system 2 is put in the inspection mode by switching an inspection switch 16 to an INSPECTION position. The inspection switch 16 is located with the inspection controls 14 on top of the elevator car 4. Placing the elevator system 2 in the inspection mode prevents normal operation of the elevator system 2. Normal operation of the elevator system 2 may be resumed by switching the inspection switch 16 to a NORMAL position (subject to normal operation not being otherwise prevented).

During an inspection run, the technician therefore operates the controls 14 from the top of the elevator car 4 within the hoistway 6. In order to mitigate the risks associated with moving the elevator car 4 whilst a technician is within the hoistway 6, an emergency stop switch 18 is also provided on top of the elevator car 4, which can be operated by the technician to stop all motion of the elevator car 4 in case of an emergency to prevent injury. A secondary emergency stop switch 20 is also provided in a pit 22 of the hoistway 6.

The hoistway door switches 12*a*, 12*b*, 12*c*, the inspection controls 14, the inspection switch 16 and the emergency stop switch 18 are all connected to an elevator controller 24. The elevator controller 24 controls operation of the elevator car 4 (e.g. by receiving elevator calls and dispatching elevators to serve them).

Before performing any inspection from within the hoistway 6, a technician must be confident that the hoistway door switches 12*a*, 12*b*, 12*c*, the inspection switch 16 and the emergency stop switch 18 are not faulty.

Figure 2:
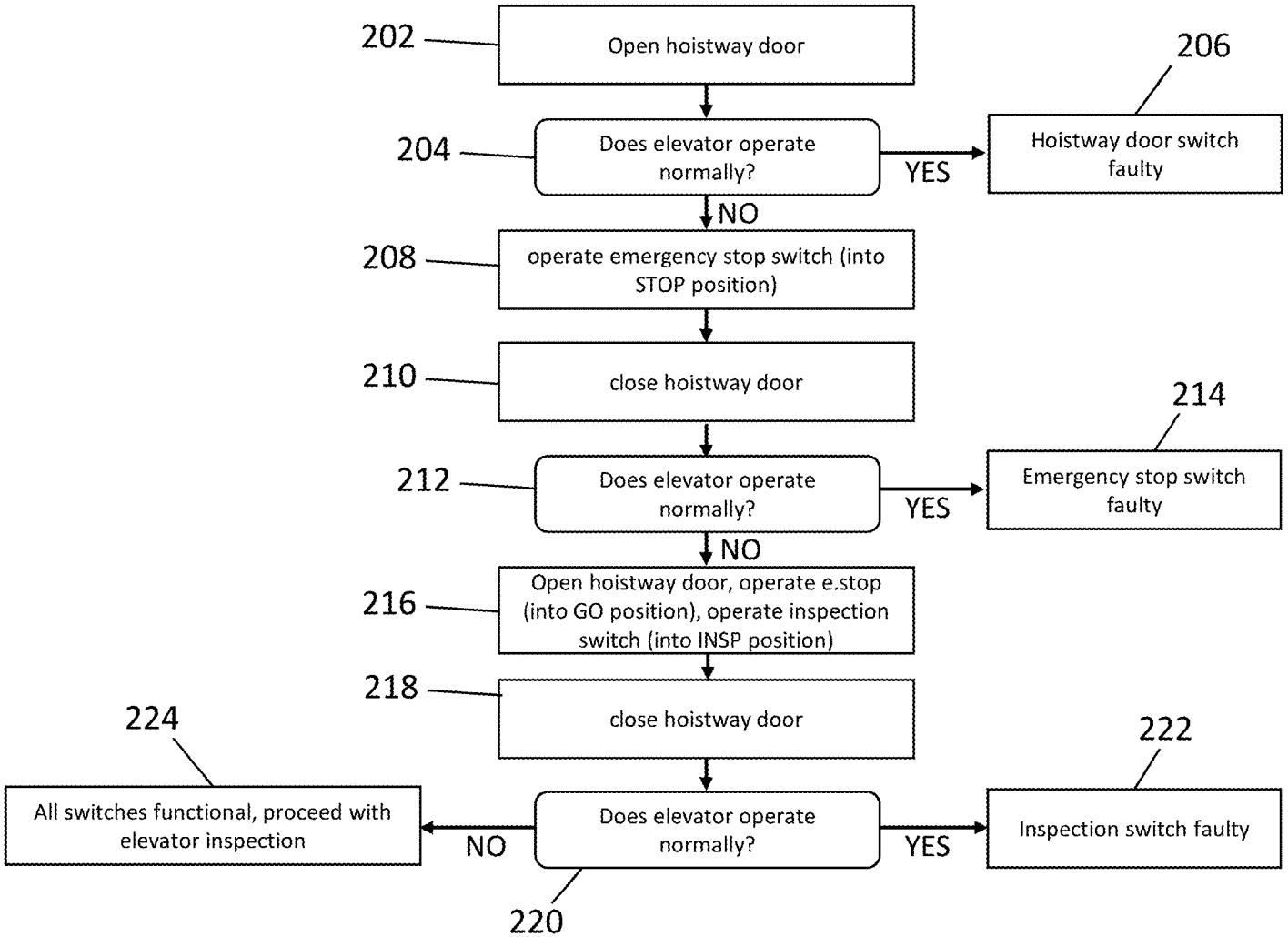
Figure 2 PRIOR ART
FIG. 2 is a flow chart illustrating a conventional (prior art) method of activating an inspection mode of an elevator system.

A conventional method for operating the elevator system 2 which aims to ensure safe inspection hoistway access is shown in FIG. 2. The process of FIG. 2 will be discussed here in relation to a particular example with reference to FIG. 1, in which a technician is located on the second floor 8*c* of the building. In step 202, the hoistway door 10*c* of the second floor 8*c* is opened (e.g. using an override switch or through manual means) to grant access to the hoistway 6. The correct operation of the hoistway door switch 12*c* is then checked at step 204 by testing if the elevator system 2 operates normally (e.g. by placing an elevator call on a hall call input panel). If the elevator car 4 begins to move even whilst the hoistway door 10*c* is open, the technician knows that the hoistway door switch 12*c* (which should prevent normal operation whilst the hoistway door 10*c* is open) is faulty and can investigate accordingly in step 206. However, if normal operation is successfully prevented, the technician can be confident in the operation of the hoistway door switch 12*c* and can proceed to step 208.

In step 208, the technician reaches into or enters the hoistway 6 (e.g. by stepping onto the top of the elevator car 4, which is aligned with the first floor 8*b*). The emergency stop switch 18 is placed into the STOP position (which should prevent all movement of the elevator car 4 no matter the setting of other switches). Then, in step 210, the technician fully exits the hoistway 6 and closes the hoistway door 10*c* (so that the emergency stop switch 18 is the only mechanism preventing movement of the elevator car 4 and is thus tested individually).

In step 212, the operation of the elevator system 2 is again checked (as in step 204). If the elevator car 4 begins to move, the technician knows that the emergency stop switch 18 is faulty and can investigate accordingly in step 214. If, however, movement of the elevator car 4 is correctly prevented, the technician proceeds to step 216, in which the hoistway door 10*c* is opened, the emergency stop switch 18 placed in the GO position and the inspection switch 16 placed in the INSPECTION position (which should enable inspection mode and prevent normal operation of the elevator system 2).

The technician then, in step 218, again fully exits the hoistway 6 and closes the hoistway door 10*c* (as in step 210). Normal operation of the elevator system 2 is then checked in step 220. If the elevator car 4 begins to move, the technician knows that the inspection switch 16 is faulty and can investigate accordingly in step 222. However, if movement of the elevator car 4 is correctly prevented, the technician can proceed to step 224, in which he enters the hoistway 6 and uses the inspection controls 14 to perform an inspection run.

By following all these steps, the technician can be sure that each of the switches is operating correctly before he enters the hoistway 6 and performs the inspection run (i.e. before he is placed in any risk of injury if the elevator car 4 moves unexpectedly). However, this procedure is long and relies upon the diligence of the technician to correctly perform each of the steps. If the technician, for instance, neglects (e.g. through lack of training or forgetfulness) to test the emergency stop switch 18 before entering the elevator hoistway 6, the inspection run can still be performed (despite the functionality of the emergency stop switch 18 being not guaranteed). This can lead to unsafe inspection operation and may even lead to serious injury if a switch is indeed faulty and normal operation of the elevator system 2 is not prevented when it should be.

Figure 3:
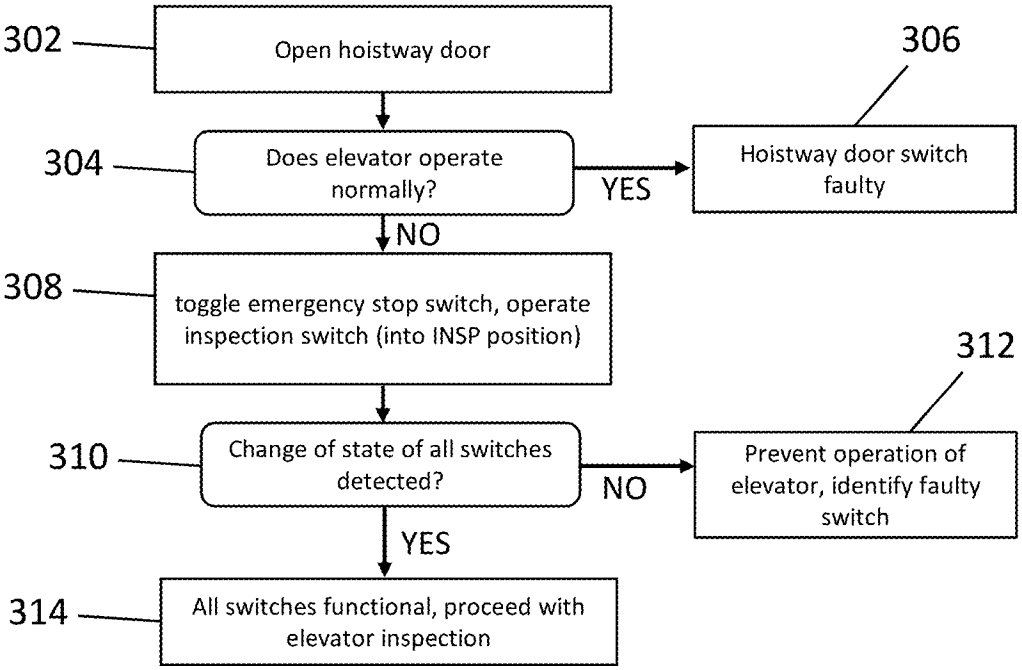
FIG. 3 is a flow chart illustrating a method of operating an elevator system according to an example of the present disclosure.

However, FIG. 3 shows a method according to an example of the present disclosure which resolves many of these issues.

As for the method described with reference to FIG. 2, a technician is assumed to be located on the second floor 8*c* of the building and wishes to access the top of the elevator car 4 to perform an inspection run.

In step 302, the technician opens the hoistway door 10*c* of the second floor 8*c*. The correct operation of the hoistway door switch 12*c* is then checked in step 304 by testing if the elevator system 2 operates normally (e.g. by placing an elevator call on a hall call input panel). If the elevator car 4 begins to move even whilst the hoistway door 10*c* is open, the technician knows that the hoistway door switch 12*c* (which should prevent normal operation whilst the hoistway door 10*c* is open) is faulty and can investigate accordingly in step 306. However, if normal operation is successfully prevented, the technician can be confident in the operation of the hoistway door switch 12*c* and can proceed to step 308.

In step 308, the technician enters (or reaches into) the hoistway 6, stepping (or reaching) onto the top of the elevator car 4, which is aligned with the first floor 8*b*. The technician toggles the emergency stop switch 18 (into a STOP position then into a GO position), and then operates the inspection switch 16 into the INSPECTION position.

The elevator controller 22 continuously monitors the states of the hoistway door switches 12*a*, 12*b*, 12*c*, the inspection switch 16 and the emergency stop switch 18. Once the elevator controller 22 detects a change of state on all three of the switches involved, it will permit inspection mode operation. Thus with the inspection switch 16 in the INSPECTION position, it places the elevator system 2 into an inspection mode, in which the elevator inspection controls 14 may be used by the technician to control the elevator car 4.

However, if the elevator controller 22 does not detect a change of state on all switches, it prevents inspection mode operation of the elevator car 4, even though the inspection switch 16 is in the INSPECTION position. Furthermore, if a change of state is detected on at least one but not all of the switches the elevator controller 22 may prevent all operation of the elevator car 4. Thus, all the relevant switches must be functioning correctly for the elevator system 2 to enter the inspection mode, and the technician can be confident that no unexpected elevator car 4 movement will occur. The method outlined with reference to FIG. 3 does not require the technician to exit and enter the hoistway or manually test the operation of the elevator system 2 several times. It is thus faster than conventional procedures (e.g. shown in FIG. 2) and cannot be bypassed by an untrained or forgetful technician.

As discussed above, in some examples, the system may additionally check for changes of state in one or more of an up button, a down button and a command button of the elevator inspection controls which may be provided on top of the elevator car and may accordingly prevent inspection mode operation until such changes of state have been duly verified. Again this adds very little time to the process as a simple press or toggle of each switch is all that is required to verify that the buttons are operational.

What is claimed is:

1. An elevator system comprising:

a hoistway accessible by at least one hoistway door;

at least one elevator car located in the hoistway;

a hoistway door switch associated with the at least one hoistway door;

at least one inspection switch;

at least one emergency stop switch; and an elevator controller;

wherein the elevator controller is configured:

to monitor the hoistway door switch, the inspection switch and the emergency stop switch; and to prevent inspection mode operation of the elevator car until at least one change of state is detected of each of the hoistway door switch, the inspection switch and the emergency stop switch.

2. The elevator system as claimed in claim 1, wherein the inspection switch is located within the hoistway.

3. The elevator system as claimed in claim 2, wherein the inspection switch is located on top of the elevator car or in a hoistway pit area.

4. The elevator system as claimed in claim 1, further comprising a set of elevator inspection controls.

5. The elevator system as claimed in claim 1, wherein the emergency stop switch is located within the hoistway.

6. The elevator system as claimed in claim 5, wherein the emergency stop switch is located on top of the elevator car or in a hoistway pit area.

7. The elevator system as claimed in claim 1, further comprising one or more additional switches and wherein the elevator controller is further configured to prevent inspection mode operation of the elevator car until at least one change of state is detected of each of the one or more additional switches.

8. The elevator system as claimed in claim 1, wherein the elevator controller is arranged to indicate the switches of which at least one change of state has been detected.

9. The elevator system as claimed in claim 1, wherein the elevator controller is configured to prevent all operation of the elevator system if a change of state is detected of at least one, but not all of the switches.

10. A method of operating an elevator system comprising at least one elevator car located in a hoistway, said hoistway being accessible by at least one hoistway door, the method comprising:

monitoring a hoistway door switch associated with the at least one hoistway door, an inspection switch and an emergency stop switch; and preventing inspection mode operation of the elevator car until at least one change of state is detected of each of the hoistway door switch, the inspection switch and the emergency stop switch.

11. The method as claimed in claim 10, further comprising subsequently returning the elevator system to a normal mode if, whilst the elevator system is operating in the inspection mode, the inspection switch is placed into a normal operation position.

12. The method as claimed in claim 11 wherein, once normal operation has been resumed from the inspection mode, further comprising preventing subsequent operation of the elevator system in the inspection mode until another change of state is detected of each of the hoistway door switch, the inspection switch and the emergency stop switch.

* * * * *